US006571675B2

(12) United States Patent
Widmann

(10) Patent No.: US 6,571,675 B2
(45) Date of Patent: Jun. 3, 2003

(54) METHOD FOR WRAPPING FIREWORK SHELLS

(76) Inventor: James Cowden Widmann, 15 Roosevelt St., Norwalk, CT (US) 06851

( * ) Notice: Subject to any disclaimer, the term of this patent is extended or adjusted under 35 U.S.C. 154(b) by 0 days.

(21) Appl. No.: 09/977,658

(22) Filed: Oct. 15, 2001

(65) Prior Publication Data

US 2003/0070539 A1 Apr. 17, 2003

(51) Int. Cl.[7] ..... F42B 4/30; B65B 11/04

(52) U.S. Cl. ..... 86/1.1; 86/20.1; 53/211; 53/216; 156/186

(58) Field of Search ..... 53/211, 216; 156/186; 428/36.3; 86/1.1, 20.1

(56) References Cited

U.S. PATENT DOCUMENTS

| | | | | |
|---|---|---|---|---|
| 2,285,334 A | * | 6/1942 | Hurt | 242/435 |
| 2,311,339 A | * | 2/1943 | Huse | 242/435 |
| 3,533,869 A | * | 10/1970 | Ikeda et al. | 156/171 |
| 4,005,233 A | * | 1/1977 | Dritt et al. | 428/36.3 |
| 5,463,842 A | | 11/1995 | Lancaster | 53/399 |
| 5,483,785 A | | 1/1996 | DiCarlo | 53/556 |
| 5,487,255 A | | 1/1996 | Soderberg | 53/399 |
| 5,568,716 A | | 10/1996 | Kluver et al. | 53/399 |
| 5,706,631 A | | 1/1998 | Conrad | 53/499 |

FOREIGN PATENT DOCUMENTS

JP 2002250599 A * 9/2002 ..... F42B/4/30

OTHER PUBLICATIONS

Fireworks, the Art, Science and Technique by Dr. Takeo Shimizu, 1981, pp. 246–252.

* cited by examiner

*Primary Examiner*—Charles T. Jordan
*Assistant Examiner*—Tara M Golba
(74) *Attorney, Agent, or Firm*—Gordon & Jacobson, P.C.

(57) ABSTRACT

An apparatus for wrapping fireworks shells is provided and includes a base provided with preferably three support rollers configured to support a spherical firework shell thereon; stepper motors coupled to two of the rollers, a computer coupled to the stepper motors to control the movement of the stepper motors and thereby control the angular rotation of the shell on the rollers, and a dispenser assembly which dispenses continuous-feed tape for wrapping the shell and applies and presses the tape to the shell as the shell is rotated on the rollers. The computer instructs the stepper motors to systematically, at times, rotate the rollers at relatively different speeds, such that a shell on the rollers is subjected to angular rotation and-the tape is evenly applied to all portions of the shell such that the tape forms a very even casing of the firework shell.

14 Claims, 4 Drawing Sheets

METHOD FOR WRAPPING FIREWORK SHELLS

BACKGROUND OF THE INVENTION

1. Field of the Invention

This invention relates broadly to apparatus for wrapping spherical objects. More particularly, this invention relates to an apparatus for wrapping tape about a spherical aerial firework shell.

2. State of the Art

Aerial firework shells generally include a shell portion containing an arrangement of bursting charge and stars, and a fuse extending from outside the shell to the interior thereof to ignite the bursting charge and stars. The stars are pellets which burn in color and provide the spectacular display of the firework. The bursting charge is generally black powder and provides the force which disperses the stars when the firework shell is shot.

There are generally two types of aerial firework shells: cylinder shells and spherical shells. Cylinder shells are originally Italian in design and contain the bursting charge and stars in a cylindrical casing. Spherical shells are originally Chinese in design and contain the bursting charge and stars in a spherical casing. Spherical shells generally come in one of several standard sizes, diameters of six inches, eight inches, ten inches, twelve inches, and sixteen inches, although other sizes can be constructed. It is the spherical shell which is most common at large professional firework displays, such as seen on the fourth of July.

In the prior art, spherical firework shells are made entirely by hand. Two hemispherical shell portions are each filled with bursting charge and stars and then brought together to form a sphere. A single piece of tape is manually applied to the sphere to temporarily maintain the integrity of the sphere. One of the shell portions is provided with a fuses which extends from outside the portion to the interior of the shell adjacent the bursting charge. The sphere is then evenly wrapped in individual strips of kraft paper, each generally one to two inches wide and having a length which is substantially the diameter of the sphere. The kraft paper is applied to the sphere using a paste, in a manner similar to papier-maché. The paper wrapping integrates the shell and provides a casing having the necessary structural integrity to permit the shell to be shot from a cannon and not allow the shell to explode until the lit fuse extending between the exterior of the casing and the interior black powder reaches the black powder. To that point, when the shell is wrapped, care is taken to wrap around the fuse, and not cover or otherwise inhibit the function of the fuse. The wrapping of the casing must be very evenly applied in thickness for the shell to explode in a substantially uniform spherical display, as desired. In order that the pasted kraft paper strips should have the required structural integrity, typically forty layers or more of the paper strips are provided about the shell to form a sufficiently strong outer casing.

This paper wrapping process is very labor intensive, requiring hours of manual work for small shells, and days of work for the largest shells. Moreover, the wrapping can be extremely dangerous as the bursting charge is highly combustible. Unfortunately, due to the labor costs, the job of firework manufacture has typically fallen on women and children working under unsafe conditions in economically depressed areas. Widespread disregard for industrial safety and lax enforcement of existing laws lead to frequent deadly accidents in such areas. Recent deaths in China have highlighted the problem. On Mar. 20, 2001, two children were killed in rural China in an explosion at an illegal fireworks factory. Just days before, on Mar. 7, 2001 an explosion at a school in China where children were forced to make fireworks in classrooms killed at least 42 people, mostly children.

SUMMARY OF THE INVENTION

It is therefore an object of the invention to provide a spherical firework shell wrapping system which minimizes human contact with the shell.

It is another object of the invention to provide a system which automatically wraps a spherical firework shell.

It is a further object of the invention to provide a system which evenly wraps a shell of a spherical firework to provide a desirable casing for the firework shell.

It is an additional object of the invention to provide a firework shell wrapping system which is relatively safe to use.

It is also an object of the invention to provide a wrapping system which can evenly wrap spherical objects other than firework shells.

In accord with these objects, which will be discussed in detail below, an apparatus for wrapping fireworks shells is provided and includes a base provided with preferably three support rollers configured to support a spherical firework shell thereon, stepper motors coupled to two of the rollers, a computer coupled to the stepper motors to control the movement of the stepper motors and thereby control the angular rotation of the shell on the rollers, and a dispenser assembly which dispenses continuous-feed tape for wrapping the shell and applies and presses the tape to the shell as the shell is rotated on the rollers. The computer instructs the stepper motors to systematically, at times, rotate the rollers at relatively different speeds, such that a shell on the rollers is subjected to angular rotation and the tape is evenly applied to all portions of the shell such that the tape forms a very even casing of the shell. Additional containment rollers are preferably provided to contain a spherical shell as it is rotated on the support rollers.

In order to accommodate different sizes of spherical shells, different apparatus may be particularly configured for specific sizes of shells: the spacing of the rollers and the height of the applying and pressing components of the dispenser assembly are based upon shell size. As an alternative, an embodiment of an adjustable apparatus in which the roller spacing and the height of the applying and pressing components are both adjustable in order to accommodate shells of different sizes in a single apparatus is also provided.

In operation, a shell is initially assembled by hand from two shell half portions, each provided with the bursting charge and stars, into a sphere. A single piece of tape is manually applied to the sphere to temporarily maintain the integrity of the sphere. Thus far, the assembly is performed in the conventional manner with one exception. No fuse is provided in the sphere. Rather, according to an aspect of the invention, at the fuse hole, a small marker such as a magnet is fixed, for example, with a piece of tape.

Then, according to the invention, the spherical shell is provided on the rollers, and tape from the dispenser is contacted with a portion of the sphere and pressed thereto such that it adheres to the shell. The stepper motors are then activated by the computer to rotate the shell in a pattern which applies multiple layers of tape relatively evenly about the shell. The wrapping is considered complete when sufficient tape in a sufficiently even application is present to form the desired casing.

After the shell is wrapped, a suitable device is used to locate the marker for the fuse. For example, if the marker is a magnet, iron filings can be placed on the shell to locate the marker. The casing is then carefully cut at the marker location to remove the marker, expose the fuse hole, and a fuse is fed through the casing and into the shell and sealed with epoxy to complete the firework.

With the apparatus of the invention, the time for wrapping fireworks shells is greatly reduced to minutes, rather than the hours or days of the prior art. Moreover, once started, the apparatus can run substantially unassisted and therefore provides a much safer method of manufacture than the completely handmade method.

It will be further appreciated that the wrapping apparatus can be used to wrap any other spherical object in a manner similarly described with respect to the firework shells.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
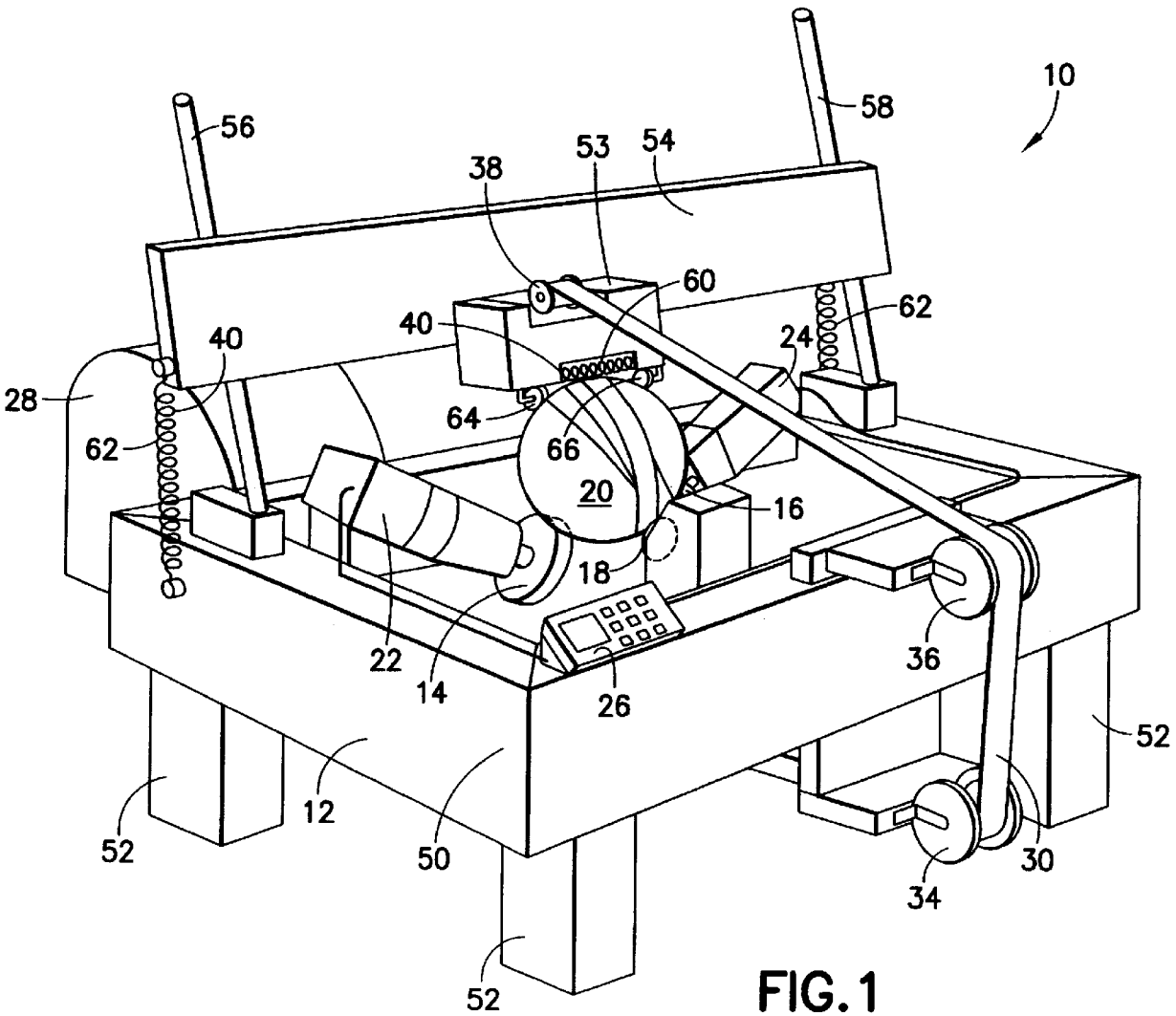
FIG. 1 is a perspective view of an apparatus for wrapping fireworks shells according to the invention.
Figure 2:
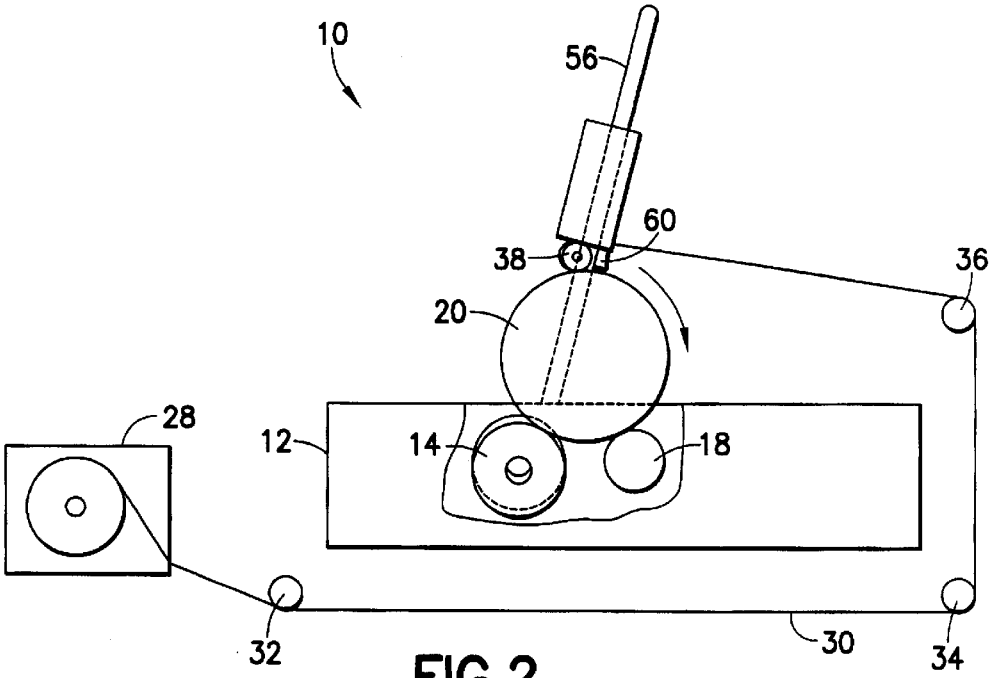
FIG. 2 is a schematic side view of the apparatus for wrapping fireworks shells.
Figure 3:
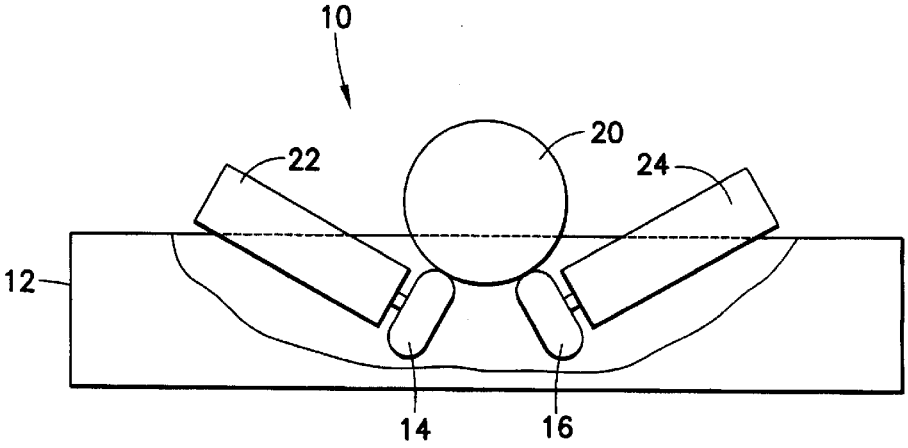
FIG. 3 is a schematic front end view of a portion of the apparatus for wrapping fireworks shells.

Turning now to FIGS. 1 through 3, an apparatus for-wrapping fireworks shells 10 generally includes a base 12 provided with preferably three support rollers 14, 16, 18 configured to support a spherical firework shell 20 of a predetermined size thereon, stepper motors 22, 24 coupled to two of the rollers 14, 16, and a computer 26 electrically communicating with the stepper motors 22, 24 to control the movement of the stepper motors and thereby control the angular rotation of the shell 20 on the rollers 14, 16, 18. Also included are a dispenser 28 which stores and feeds a continuous roll of tape 30 for wrapping the shell, spools 32, 34, 36, 38 for guiding the tape 30 from the dispenser to the shell, and a pressure applicator 40 that presses the tape to the shell 20 as the shell is rotated on the rollers. Preferred tape include one to two inch, 40 to 60 lb tape.

More particularly, the base 12 includes a frame 50 and legs 52 which support the frame. The stepper motors 22, 24 are preferably rigidly coupled to the frame 50 and include rollers 14, 16, respectively at the ends thereof. Support roller 18 is also coupled to the frame 50 such that the support rollers 14, 16, 18 are in a triangular arrangement, and adapted to stably support the spherical shell 20. The support rollers are preferably made from 30 durometer silicon rubber 6r another preferably elastomeric material that provides the necessary traction to cause the shell. 20 to rotate when the support rollers are rotated. Additionally, one or more of the rollers may be embedded with exposed metal studs to increase traction. Other means for traction, i.e., an elastomeric or non-elastomeric roller material provided with a high friction surface coating or exposed material or elements, may be used.

The dispenser 28 is adapted to hold a relatively large roll of tape 30. The tape 30 includes a preferably water-activated adhesive, and the dispenser includes means (not shown) for applying water to the adhesive side of the tape. Such means may include a bath through which the tape is pulled or a wet sponge or rolling element against which the tape is contacted as the tape is pulled from the tape roll.

The tape 30 extends from the dispenser 28 and across spools 32 and 34, which are located to guide the tape under the frame 50. The tape then extends up to spool 36 which guides the tape to spool 38 (over a shell resting on the rollers). The adhesive side of the tape is oriented outward such that it is not in contact with any of the spools. Spool 38 is configured to then guide the tape 30, adhesive side down, onto a shell 20 located on the rollers 14, 16, 18.

Spool 38 is mounted via a mount 53 on a bar 54. The bar 54 is slidable along posts 56, 58 which extend generally upward from the frame 50. The posts are angled at an elevation angle of at least 45°, and preferably at an elevation angle between 70° and 90°. The pressure applicator 40 includes a contact element 60 also on the mount 53 which directly presses tape 30 from the spool 38 onto the shell 20, and springs 62 coupled to both the frame 50 and the bar 54 which urge the contact element 60 against a shell 20 located on the rollers. The contact element 60 is preferably a metal coil (e.g., a stiff metal spring) which is generally horizontally oriented at a lower portion of the mount 53 such that the windings of the coil press the tape 30 into the shell 20. Containment rollers 64, 66 are provided at a lower portion of mount 53 about the contact element 60 and operate to contain a spherical shell spinning on the support rollers, but preferably do not support any weight of the shell.

The space between the rollers and the extent to which the bar 54, and therefore spool 38 and contact element 60, can move up on the posts 56, 58 is preferably optimized for a particular shell diameter. As such, different shell diameters may require the use of specifically configured apparatus. Table 1 provides approximate presently preferred spacings between the support rollers 14, 16, 18 for different size shells.

TABLE 1

| | Support Roller Spacing | |
|---|---|---|
| Shell Size | Space between center of support rollers 14 and 16 | Space between support roller 18 and a line extending between the center of rollers 14 and 16 |
| 4 inch | 3 inch | 3.25 inch |
| 5 inch | 3.25 inch | 3.5 inch |
| 6 inch | 3.75 inch | 4 inch |
| 8 inch | 4.25 inch | 4.5 inch |
| 10 inch | 5 inch | 5.75 inch |
| 12 inch | 5.5 inch | 6.25 inch |

The computer 26 controls the amount (i.e., speed) of rotation of the stepper motors 22, 24. The computer 26 may be physically located on the frame 50 (as shown), or may be separately located from the frame, for example, as a personal computer (not shown) coupled to an interface (not shown)

which is coupled to the stepper motors. The computer 26 includes a memory that stores one or more programs for operation of the stepper motors (preferably in computer numerical code or 'CNC') and a processor which instructs the stepper motors to rotate in accord with a program loaded from the memory. The programs are adapted to individually control the amount of rotation of the motors. By individually controlling the amount of rotation of the stepper motors, and consequently the support rollers attached thereto, the shell is made to rotate in a desired manner such that, at times, the shell is subject to angular rotation. Controlling the rotation of the shell permits the tape to be applied to the shell in a manner which completely covers the shell.

For example, when both support rollers 14, 16 are rotated by the same amount, the shell is rotated about a first axis aligned with support roller 18. When the computer 26 causes the stepper motors 22, 24 to rotate the support rollers 14, 16 by relatively different amounts, the shell 20 then rotates about other axes. According to a preferred tape wrapping pattern, the stepper motors are controlled to rotate the shell in a 'figure 8' pattern: the shell is rotated about the first axis for a distance of preferably approximately forty percent of the shell circumference, the rotation is then skewed (by offsetting the relative rotational speeds of the stepper motors 14, 16) to the left (or the right) for preferably approximately ten percent of the shell circumference, the shell is again rotated about the first axis for a distance of preferably approximately forty percent of the shell circumference, and then the rotation is skewed back to the right (or the left) for preferably approximately ten percent of the shell circumference. As such, after each 360° rotation of the shell, the location being contacted with tape is offset relative to the location of the tape prior to that revolution of the shell. The order of the axial and skewed-rotations, providing straight and curved paths for the tape on the shell, may be altered.

By way of one example, and not by limitation, the following algorithm for controlling the stepper motors is provided and has been shown to provide excellent tape coverage:

rotate skewed left for 0.1 times circumference of the shell
rotate straight for 0.4 times circumference of the shell
rotate skewed right for 0.1 times circumference of the shell
rotate straight for 0.4 times circumference of the shell
repeat ten times
provide offset in rotational speed to prevent tape from directly overlying underlayer
rotate skewed left for 0.1 times circumference of the shell
rotate straight for 0.4 times circumference of the shell
rotate skewed right for 0.4 times circumference of the shell
rotate skewed right for 0.1 times circumference of the shell
rotate straight for 0.4 times circumference of the shell
repeat five times
provide location offset to initiate taping from a different physical location on the shell
go to beginning and repeat until sufficient tape thickness One skilled in the art of computer numerical code (CNC) and its control of stepper motors will be able to design the necessary CNC for the desired rotation of the shell. The particular CNC will be based upon the shell size, the support roller diameter, the relative angle between the support rollers, the width of the tape, and the thickness of the tape.

In a less preferred algorithm for tape application, the stepper motors may be operated to allow complete rotation of the shell prior to temporarily offsetting the motor speeds, then allowing another complete rotation, and then temporarily offsetting the speeds, etc. As yet another alternative, the support rollers 14, 16 may always be rotated at relatively different speeds such that the tape is always applied obliquely relatively to an axis of rotation.

Figure 5:
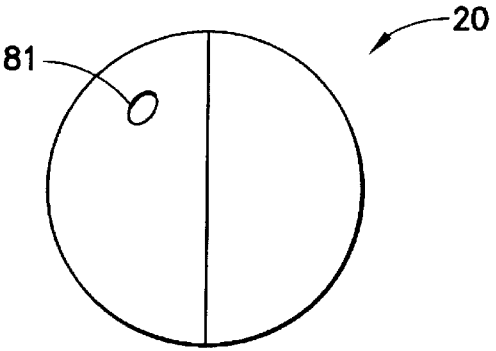
FIGS. 4–7 illustrate the initial assembly of a spherical firework shell according to the invention.
Figure 4:
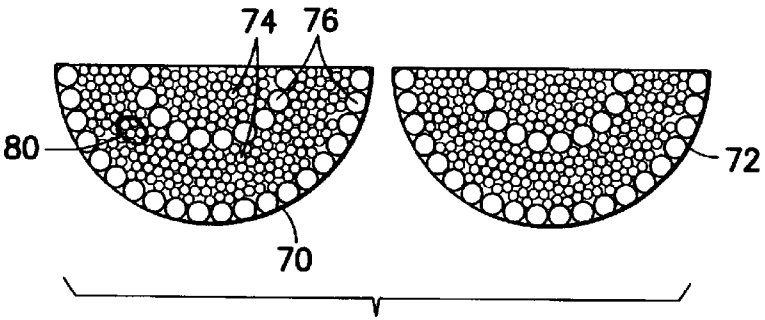
Figure 6:
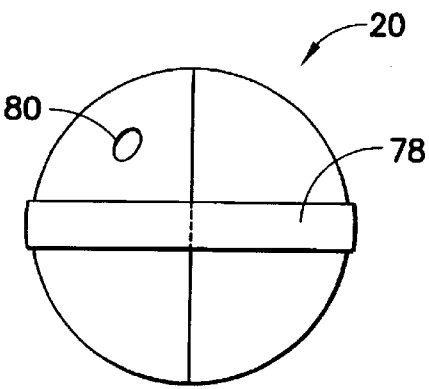

In operation, initially, two paper shell half portions (hemishells) 70, 72 (FIG. 4), each provided with bursting charge. 74 and stars 76, are assembled into a spherical shell 20 (FIG. 5). A single piece of tape 78 (FIG. 6) is manually applied to the shell to temporarily maintain the integrity of the sphere. Thus far, the assembly is performed in the conventional manner with one exception. No fuse is provided in the sphere. Rather, referring to FIG. 6, according to preferred aspect of the invention, a tube 80 is provided in a fuse hole 81 (FIG. 5) flush or recessed with the outer surface of the shell. A marker such as a small magnet 82 is then fixed, for example, with a piece of tape 84 over the end of the tube.

Then, referring back to FIG. 1, according to the invention, the spherical shell 20 is provided on the rollers 14, 16, 18, and tape 30 from the dispenser 28 is contacted with a portion of the sphere and pressed thereto by the contact element 60 of the pressure applicator 40 such that it adheres to the shell. The stepper motors 22, 24 are activated by the computer to rotate the support rollers 14, 16, and consequently the shell about a first axis. The containment rollers 64, 66 stabilize the shell on the support rollers during shell rotation. The tape is applied according to one of the algorithms discussed above, with the tape strip on the shell having a length many times (preferably at least ten and potentially hundreds of times) the diameter of the shell. The shell is wrapped until a sufficient thickness of tape is present to form the desired casing.

Figure 8:
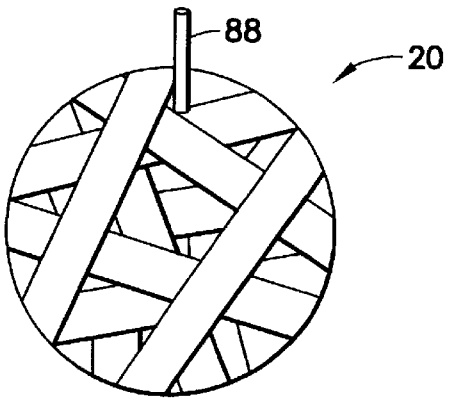
FIG. 8 illustrates using a device to locate a fuse marker.
Figure 7:
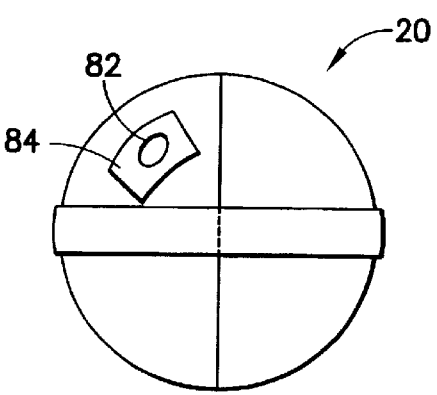

Referring to FIG. 8, after the shell 20 is wrapped, it is substantially spherical without substantial surface aberration. This is the result of the manner of wrapping and the usage of a relatively flat marker. A suitable element is then used to locate the marker for the fuse. For example, if the marker is a magnet, iron filings can be placed on the shell to locate the markers. The casing is then carefully cut at the marker location with a plug cutter to expose the marker 82 and tube 80 in the fuse hole. After the marker is removed, a fuse 88 is fed through the tube 80 into casing. An epoxy or other sealant is, then applied about the fuse 88 to provide a seal and complete the firework shell.

With the apparatus 10 of the invention, the time for wrapping fireworks shells is greatly reduced, from days to hours, or from hours to minutes, depending on the size of the shell. Moreover, once started, the apparatus 10 can run substantially unassisted and therefore provides a much safer method of manufacture than the completely handmade method.

Figure 9:
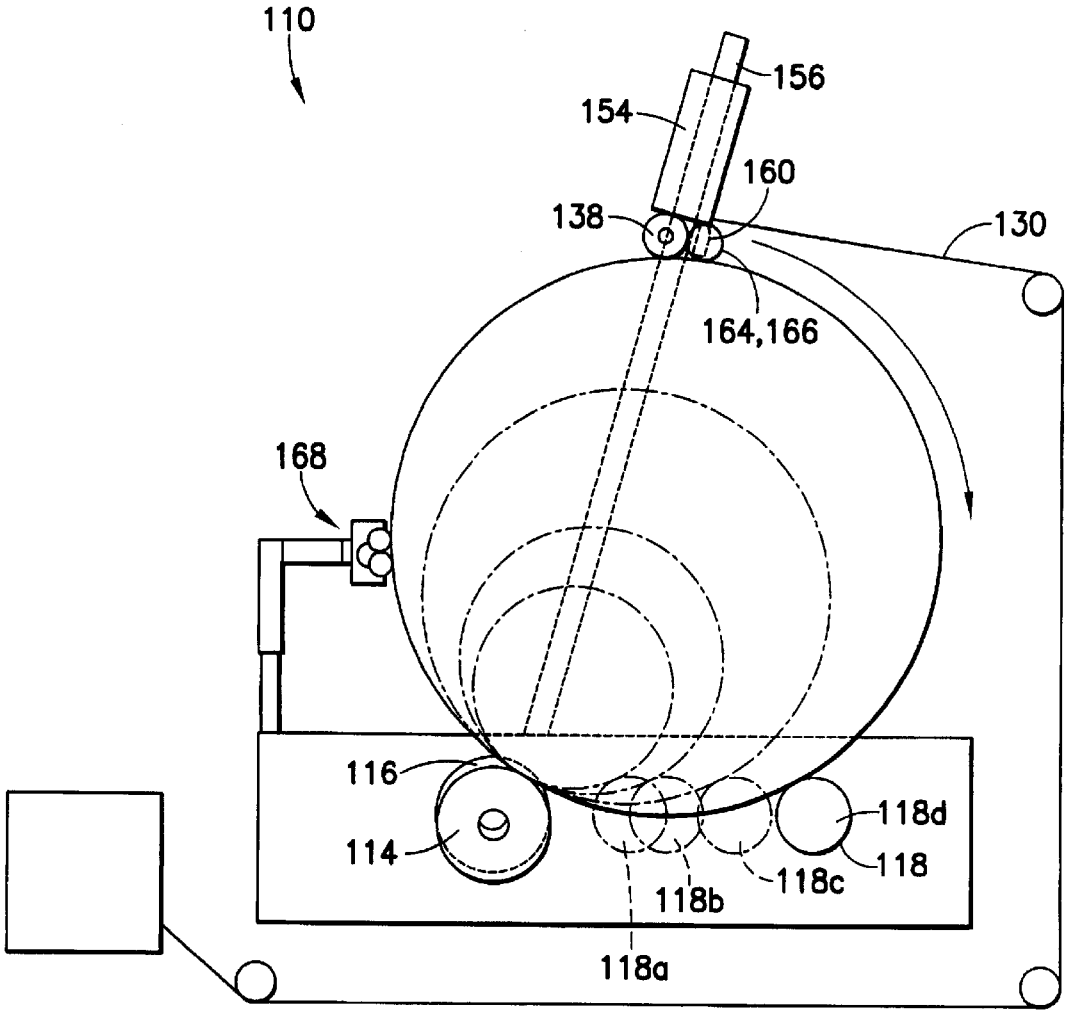
FIG. 9 is a schematic illustration showing an adjustable embodiment of the apparatus for wrapping fireworks shells adapted to wrap spherical shells of various diameters.

Turning now to FIG. 9, an embodiment of an adjustable firework shell wrapping apparatus 110 able to accommodate shells of various sizes is shown. The adjustable apparatus 110 is substantially similar to the previously described embodiment with the following differences. First, support roller 118 can be moved relative to support rollers 114 and 116 between positions 118*a*, 118*b*, 118*c*, and 118*d* (and intermediate positions therebetween) to stably accommodate spherical shells of various sizes, e.g., 3 inches to 16 inches, and can be designed to accommodate even up to 24 or 36 inch shells. The adjustment may be effected by providing roller 118 on a bearing and having the bearing be slidably disposed along a rod. The bearing may then be slid along the rod and locked at a desired location. Other suitable mechanisms known in the mechanical arts for adjusting one element relative to another may also be used. Second, optionally, the space between support rollers 114 and 116 is adjustable. This adjustment may be affected by having the stepper motors be mounted to the frame in a manner which permits adjustment of the stepper motors relative to the frame. Third, the posts 156 are relatively long such that bar 154 can be set on the posts in a position which permits the spool 138 and contact element 160 to suitably guide and press the tape 130 to the shell, and containment rollers 164, 166 to contain the shell. Fourth, particularly useful for wrapping larger shells, a containment bearing assembly 168, e.g., comprising three bearings in a triangular arrangement, may be provided to further stabilize a shell on the support rollers. The containment bearing assembly 168 is preferably spring-loaded against a shell, and may be adjusted for different size shells. As such, the wrapping apparatus 110 is capable of accommodating shells of various sizes.

There have been described-and illustrated herein embodiments of an apparatus for wrapping fireworks shells, a method of wrapping firework shells, and a firework shell produced by the method. While particular embodiments of the invention have been described, it is not intended that the invention be limited thereto, as it is intended that the invention be as broad in scope as the art will allow and that the specification be read likewise. Thus, while a water-activated tape is disclosed for wrapping the shells, it will be appreciated that other tapes or wrapping materials can be used as well. For example, kraft paper drawn through a paste bath may be applied to the shells. In addition, while a preferred stepper motor program has been disclosed, it will be understood that other programs can likewise be used. Also, while the apparatus has been described with three rollers, it will be appreciated that additional rollers can be used to further support the shell. Furthermore, while spools are described for guiding the tape, it will be appreciated that guides of other shapes and design may be used as well. Moreover, while a metal coil has been described for applying pressure to press and/or burnish the tape to the shell, it will be appreciated that contact members of other design may be used as well. Also, while roller 18 (118) is preferably free-spinning, it may also be coupled to a motor for active rotation. In addition, while a magnetic marker is disclosed, the marker may be another metal or another material otherwise discernable, such as by x-ray or MRI. Furthermore, one or more markers may be used to point to or otherwise identify the fuse hole, rather than be provided above the fuse hole. Moreover, water or paste can be applied either right at or before the contact element, or could be applied to the shell directly near the point of contact with the tape. Also, while several tape patterns have been disclosed, it will be appreciated that yet other patterns may be used in the application of the tape to the shell. Further, as an alternative to the springs 62, pneumatic cylinders may be used. Also, while a computer with a processor and memory have been disclosed, it will be appreciated that dedicated circuitry and sensors, or any other hardware and/or software combination can be to control the stepper motors. In addition, while the embodiment of the wrapping apparatus have been described with respect to wrapping a spherical firework shell, it is recognized that the apparatus can be used to tape or wrap any spherical object sized to be positioned on the rollers. It will therefore be appreciated by those skilled in the art that yet other modifications could be made to the provided invention without deviating from its spirit and scope as claimed.

What is claimed is:

1. A method of manufacturing a spherical aerial firework shell, comprising:

a) providing a spherical shell containing bursting charge and stars;

b) providing a wrapping apparatus including
- i) rotating means for rotating the spherical shell about a plurality of axes,
- ii) a continuous strip of wrapping material, and
- iii) a dispensing assembly adapted to dispense the continuous strip of wrapping material for application to the spherical shell while the shell is rotated;

c) placing the spherical shell on the rotating means of the wrapping apparatus;

d) rotating the spherical shell; and e) applying said continuous strip of wrapping material to completely cover said spherical shell.

2. A method according to claim 1, wherein:

said providing a spherical shell includes,
- i) bringing together two hemishell portions each containing bursting charge and stars,
- ii) coupling the hemishells together to define the spherical shell, the spherical shell being provided with a fuse hole, and
- iii) placing a marker identifying the fuse hole.

3. A method according to claim 2, wherein:

said marker is substantially flat.

4. A method according to claim 2, wherein:

said marker is a magnet.

5. A method according to claim 2, wherein:

prior to placing a marker identifying the fuse hole, providing a tube in said fuse hole.

6. A method according to claims 2, further comprising:

e) locating said marker;

f) cutting a second hole in said casing to expose said fuse hole; and g) inserting a fuse into said fuse hole.

7. A method according to claim 6, further comprising:

h) applying a sealant between a base of said fuse and said second hole.

8. A method according to claim 1, wherein:

said rotating includes,
- i) rotating said spherical shell about a first axis of rotation until one of more layers of wrapping material have been applied about a diameter of said spherical shell transverse to said first axis of rotation,
- ii) rotating said spherical shell about a second axis of rotation until one-of more layers of wrapping material have been applied about a diameter of said spherical shell transverse to said second axis of rotation,
- iii) rotating said spherical shell about a third axis of rotation until one of more layers of wrapping material have been applied about a diameter of said spherical shell transverse to said third axis of rotation, and
- iv) rotating said spherical shell about a fourth axis of rotation until one of more layers of wrapping material have been applied about a diameter of said spherical shell transverse to said fourth axis of rotation.

9. A method according to claim 1, wherein:

said rotating rotates said spherical shell about greater than three axes of rotation.

10. A method according to claim 1, wherein:

said means for rotating includes,

A) a plurality of rollers configured to support the spherical shell thereon,

B) stepper motors coupled to two of said plurality of rollers, and

C) a controller coupled to said stepper motors to independently control speeds of rotation of said two rollers such that said two rollers, at times, rotate at relatively different speeds.

11. A method according to claim 1, wherein:

said rotating and said applying occur until said spherical shell is covered by a plurality of layers of said continuous strip.

12. A method according to claim 1, wherein:

said applying includes pressing said continuous strip of wrapping material onto said spherical shell.

13. A method according to claim 12, wherein:

said pressing includes burnishing.

14. A method according to claim 1, wherein:

said continuous strip of wrapping material is a tape having a water-activated adhesive, and said adhesive is activated prior to applying said wrapping material to said spherical shell.

* * * * *